United States Patent [19]

Bravin

[11] 4,232,838

[45] Nov. 11, 1980

[54] POSITIVE SELF-ORIENTING TRAVERSE APPARATUS IN WIRE TAKE-UP MACHINE

[75] Inventor: Ben Bravin, Los Angeles, Calif.

[73] Assignee: Dynamex Corporation, Long Beach, Calif.

[21] Appl. No.: 21,787

[22] Filed: Mar. 19, 1979

[51] Int. Cl.[3] ..... B65H 54/30

[52] U.S. Cl. ..... 242/158 R; 242/157.1

[58] Field of Search ..... 242/25 R, 25 A, 157.1, 242/158 R, 158 F, 158.2, 158.3, 158.4 R, 158.5; 254/190 R

[56] References Cited

U.S. PATENT DOCUMENTS

| | | | |
|---|---|---|---|
| 2,453,184 | 11/1948 | Berry | 242/158 R X |
| 3,722,827 | 3/1973 | Hrescak | 242/157.1 X |
| 3,902,701 | 9/1975 | Orme | 242/258 R X |
| 4,015,798 | 4/1977 | Benya | 242/157.1 |

*Primary Examiner*—Stanley N. Gilreath

*Attorney, Agent, or Firm*—Blakely, Sokoloff, Taylor & Zafman

[57] ABSTRACT

A positive, self-orienting traverse apparatus to be used in conjuction with a wire take-up machine for winding wire and the like onto a reel in uniform layers. The traverse apparatus includes a traverse pulley assembly disposed above the take-up reel which is driven along a path parallel to the reel axis of rotation by a reciprocating drive means. The traverse pulley assembly is provided with a traverse pulley which guides the wire onto the take-up reel, and which is mounted to pivot about a vertical axis. A non-traversing input pulley, which is also mounted to pivot about a vertical axis, is provided for guiding wire from a wire source to the traverse pulley. The input pulley is coupled to the traverse pulley by way of a telescoping orientation bar so that the two pulleys remain aligned with one another as the traverse pulley is reciprocated. Wire from the source approaches the input pulley from above (or below) coincident to the input pulley pivot axis and is passed under (or over) the input pulley and across to the traverse pulley. The wire then is passed over the traverse pulley which then guides the wire down to the take-up reel, thereby causing uniform layers to be wound.

15 Claims, 6 Drawing Figures

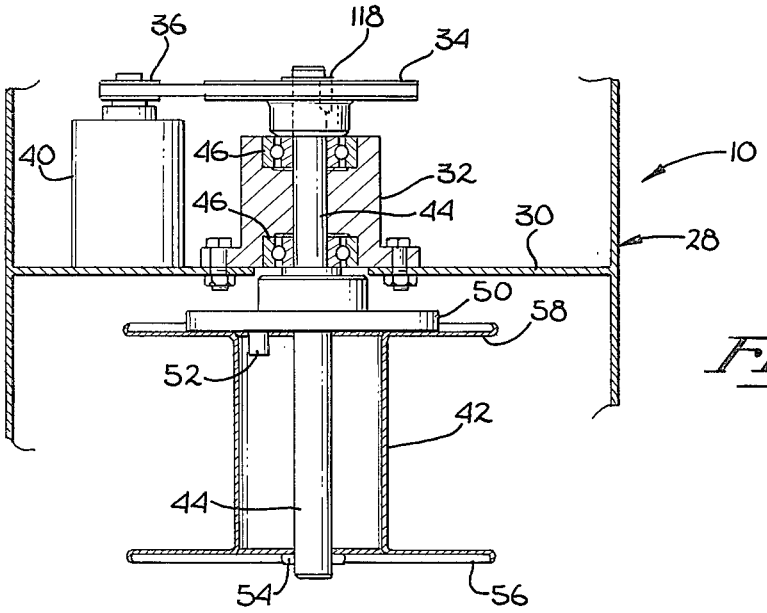
Fig. 4
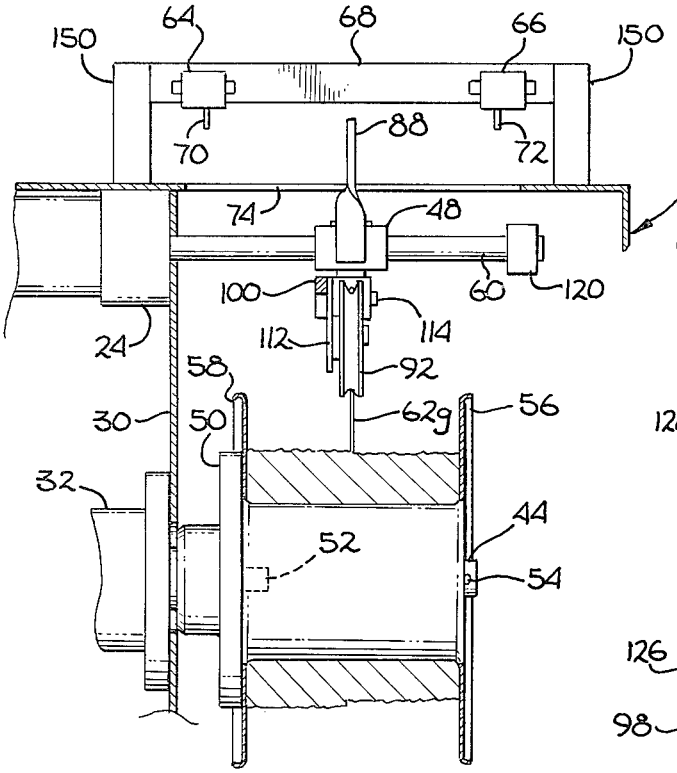
Fig. 5
Fig. 6

POSITIVE SELF-ORIENTING TRAVERSE APPARATUS IN WIRE TAKE-UP MACHINE

BACKGROUND OF THE INVENTION

1. Field of the Invention

The subject invention pertains to the field of wire winding apparatus and more particularly to an apparatus for traversing wire or the like back and forth across the width of a reel during the winding process so as to lay down even, uniform layers of wire.

3. Prior Art

In the winding of wire or the like onto reels, it is generally necessary that the wire be advanced back and forth along the width of the reel during the winding process so as to form, as nearly as possible, uniform layers of wire, each such layer comprising individual coils of wire having a desired pitch.

In the prior art, translation winders are known. Such winders reciprocate the reel laterally with respect to the incoming wire so that the wire is wound onto the reel at right angles to the reel axis of rotation. Translation winders have serious shortcomings, however, since such winders require a mechanism which must simultaneously rotate the reel about a given axis and reciprocate the reel along such axis of rotation. Such a mechanism must be capable of handling fully loaded reels, which weigh up to a few thousand pounds, and are, therefore, mechanically complex and expensive.

Other wire winders known in the prior art operate with the take-up reel fixed in place. In these winders, some form of reciprocating wire guiding mechanism is disposed between the reel and the wire source. The mechanism is typically a pulley or sheave, having an axis of rotation parallel to the reel's axis of rotation, which traverses the width of the reel between the reel flanges. The traversing pulley, which is normally V-grooved to contain the wire, reciprocates at a rate such that coils of wire are wound onto the reel in uniform layers. However, when the traversing pulley approaches an extreme position, the angle between the wire entering the pulley and the plane formed by the pulley groove often becomes large enough to cause the wire to have a tendency to climb the walls of the pulley groove and, perhaps, to be thrown from the pulley. One such apparatus is disclosed in U.S. Pat. No. 3,677,483 issued to Werner Henrich.

In addition to the disadvantageous tendency of the above-described prior art winders to throw the incoming wire from the traverse pulley when the latter approaches its extreme position, such winders also tend to rub, scuff and mark the wire. When wire enters or leaves a pulley at other than in the central plane of the groove of the pulley, the non-coincidence of the direction of wire travel and the direction of motion of the pulley groove wall causes the wire to be rubbed, scuffed and marked by the groove wall. Moreover, such non-coincidence of the directions of motion of the wire and groove wall increases the friction between them, thereby requiring an increase in the pulling force applied to the wire, i.e., the wire tension, by the take-up reel drive. Such increases in wire tension are non-uniform and tend to damage the wire.

One prior art solution for reducing the tendency of the wire to climb the walls of the pulley groove is to use a traverse pulley having a very wide angle V-groove. The wire can enter such a pulley at an angle substantially offset from the groove plane without having a tendency to climb the groove walls. Such pulleys, however, are not capable of accurately guiding the wire onto the reel; therefore, the layers formed on the reel are uneven. Thus, the primary purpose of the traversing pulley is defeated.

The angle between the wire, as it approaches the traversing pulley and the pulley groove plane, can also be reduced by placing the wire source a substantial distance from the traversing pulley. Although this solution reduces the tendency of the wire to be thrown from the pulley, the increased length of suspended wire between the wire source and the traversing pulley causes the suspended length of wire to vibrate and possibly stretch, thereby permanently damaging the wire. Furthermore, the amount of costly floor space needed for such a machine is increased substantially, and protective guards must be utilized in order to protect personnel from being injured by the suspended wire.

Another attempt to reduce the angle at which the incoming wire approaches the traversing pulley is the use of a pair of rollers, disposed between the wire source and the pulley. The closely spaced rollers are free to rotate about axes which are normal to the wire passing therebetween. The rollers move along with the traversing pulley so that the wire is guided to the traversing pulley at a constant angle. U.S. Pat. No. 3,080,128 issued to C. E. Hauer discloses the use of rollers in this manner. Although the rollers guide the wire to the traversing pulley so that the wire approaches the pulley at substantially right angles to the pulley axis of rotation, the rollers tend to damage the wire, expecially if wire of a small guage is being wound. This is because space limitations usually require the use of small diameter rollers so that the additional sharp bending produced by the rollers causes the wire to become abraded and scuffed. Furthermore, such bending causes cold work hardening of the wire, resulting in a loss of anneal.

Still another prior art configuration involves the use of a traversing pulley which is pivotally mounted so that the pulley is free to pivot about an axis which is at right angles to the pulley axis of rotation. In these configurations, a fixed input pulley, disposed between the wire source and the traversing pulley, is typically used. Since the traverse pulley is free to pivot and thereby accommodate, to a large extent, the wire approaching and exiting the pulley, the angle of the wire with respect to the pulley groove plane is reduced; therefore, the disadvantages discussed above; e.g., the tendency of the wire to climb the walls of the traverse pulley, among others, is somewhat reduced. Although this scheme is an improvement over the other prior art traversing apparatus discussed earlier, the wire angle approaching and exiting the traverse pulley is not completely eliminated. Furthermore, the fixed input pulley must accommodate the wire leaving it over a full range of angles, and, therefore, the input pulley tends to throw the wire, or abrade the wire surface or otherwise damage the wire.

Other prior art traversing apparatus, having all or some of the above shortcomings, are set forth in U.S. Pat. No. 1,657,308 issued to Jespersen; U.S. Pat. No. 3,289,956 issued to Sjogren and U.S. Pat. No. 2,254,220 issued to Hubbard.

Disclosed herein is a traverse apparatus which overcomes the above-described limitations of the prior art. This apparatus is capable of winding wire onto a reel so as to form even, uniform layers of coiled wire. Small guage wire can be wound without tension variations, cold work hardening, scuffing, rubbing or marking the wire, and without throwing the same. Furthermore, the novel apparatus disclosed herein is simple, low in cost, utilizes a minimum amount of floor space and presents little hazard to personnel working in the area.

SUMMARY OF THE INVENTION

A positive self-orienting traverse apparatus for use with wire take-up machines and the like is disclosed. Such machines typically include a horizontally-disposed reel spindle for receiving a reel and a means for driving the reel spindle. The traverse apparatus includes a traverse pulley assembly and an input pulley assembly coupled to the traverse pulley assembly by way of a telescoping orientation bar.

The traverse pulley assembly includes a traverse block slideably mounted above the take-up reel on a pair of horizontally disposed slide rails. A traverse pulley is pivotally mounted on the underside of the traverse block by means of a pulley bracket such that the pulley may pivot about an axis which is tangential to the wire-carrying groove of the pulley and also at right angles with respect to the reel axis of rotation. A reciprocating drive means is provided which is coupled to the traverse block. The drive means permits the traverse pulley assembly to be driven back and forth along the slide rails in a manner such that the pulley traverses the full width of the reel. The speed at which the pulley traverses the reel is selectable.

The input pulley assembly, which is disposed between the wire source and the traverse pulley assembly, is pivotally mounted on the apparatus by means of a pulley bracket. The input pulley is free to pivot about an axis which is both parallel to the pivot axis of the traverse pulley assembly and tangential to the input pulley groove.

The orientation bar is connected between the respective brackets of the input and traverse pulleys so that the pulleys remain aligned with one another while the traverse pulley traverses the take-up reel. When the traverse pulley is positioned directly over the center of the reel, midway between the reel flanges, the pulley axes of rotation are parallel to the reel axis of rotation. When the traverse pulley is driven off center, the orientation bar causes both pulley assemblies to pivot accordingly so that the pulleys remain aligned. The orientation bar is comprised of two telescoping members which permit the effective length of the bar to increase as the traverse pulley approaches either reel flange, and to decrease as the traverse pulley approaches the center of the reel, thereby accomodating the constantly changing distance between the two pulleys.

In operation, wire from a source is fed into the machine from above or below, such that the wire entering the machine is coincident with the vertical axis about which the input pulley pivots. The wire is passed around the input pulley and then over to the traverse pulley along a path adjacent to to the orientation bar. If the incoming wire enters the input pulley from above, it is passed around the underside of the input pulley; conversely, if the wire enters from below, it is passed over the top of the input pulley. The wire entering the traverse pulley passes over it and down to the take-up reel. The traverse pulley assembly is positioned above the take-up reel such that the wire exiting the pulley is substantially coincident with the axis about which the traverse pulley pivots when the reel is approximately half loaded with wire.

The speed at which the traverse assembly is driven, relative to the rotational rate of the reel, can be adjusted to achieve the desired pitch of the wire coils being wound onto the reel. Thus, as the traverse pulley guides the wire to the reel, uniform layers of wire are formed, each layer being comprised of coils of wire of the desired pitch (or a variable pitch if the speed of the traverse assembly is constant while that of the reel is slowed during the winding process in order to maintain a generally constant wire velocity).

The orientation bar ensures that the wire exiting the input pulley and entering the traverse pulley is at a constant right angle with respect to the parallel axes of rotation of the two pulleys. Also, the wire approaching the input pulley is coincident with the axis about which the pulley pivots, hence the pivoting action of the pulley does not adversely affect the wire. Similarly, the wire exiting the traverse pulley is approximately coincident with the axis about which the pulley pivots during the entire reeling process, therefore, the pivoting of this pulley also has no detrimental effect on the wire.

Thus, in the present invention, the wire invariably approaches and exits each pulley along a path which substantially coincides with the central plane defined by the respective pulley grooves. Consequently, nowhere along the wire path is there a non-coincidence of the directions of motion of the wire and the walls of the pulley grooves. Consequently, there is little or no tendency for the wire to climb the walls of a pulley or to be scuffed, rubbed, or marked.

Thus, the present invention overcomes the shortcomings of the apparatuses known in prior art and substantially eliminate the adverse effects upon the wire being wound caused by the angular displacement of the wire with respect to the central plane of the input and traverse pulleys.

BRIEF DESCRIPTION OF THE DRAWINGS

FIG. 4 is a fragmentary cross-sectional plan view taken substantially through section line 4—4 of FIG. 1, showing some of the details of the reel and reel-driving mechanism.

FIG. 5 is a cross-sectional end view of the invention taken substantially through section line 5—5 of FIG. 1.

FIG. 6 is a fragmentary elevational view of the input pulley and means for pivotally mounting the same.

DETAILED DESCRIPTION OF THE INVENTION

Figure 1:
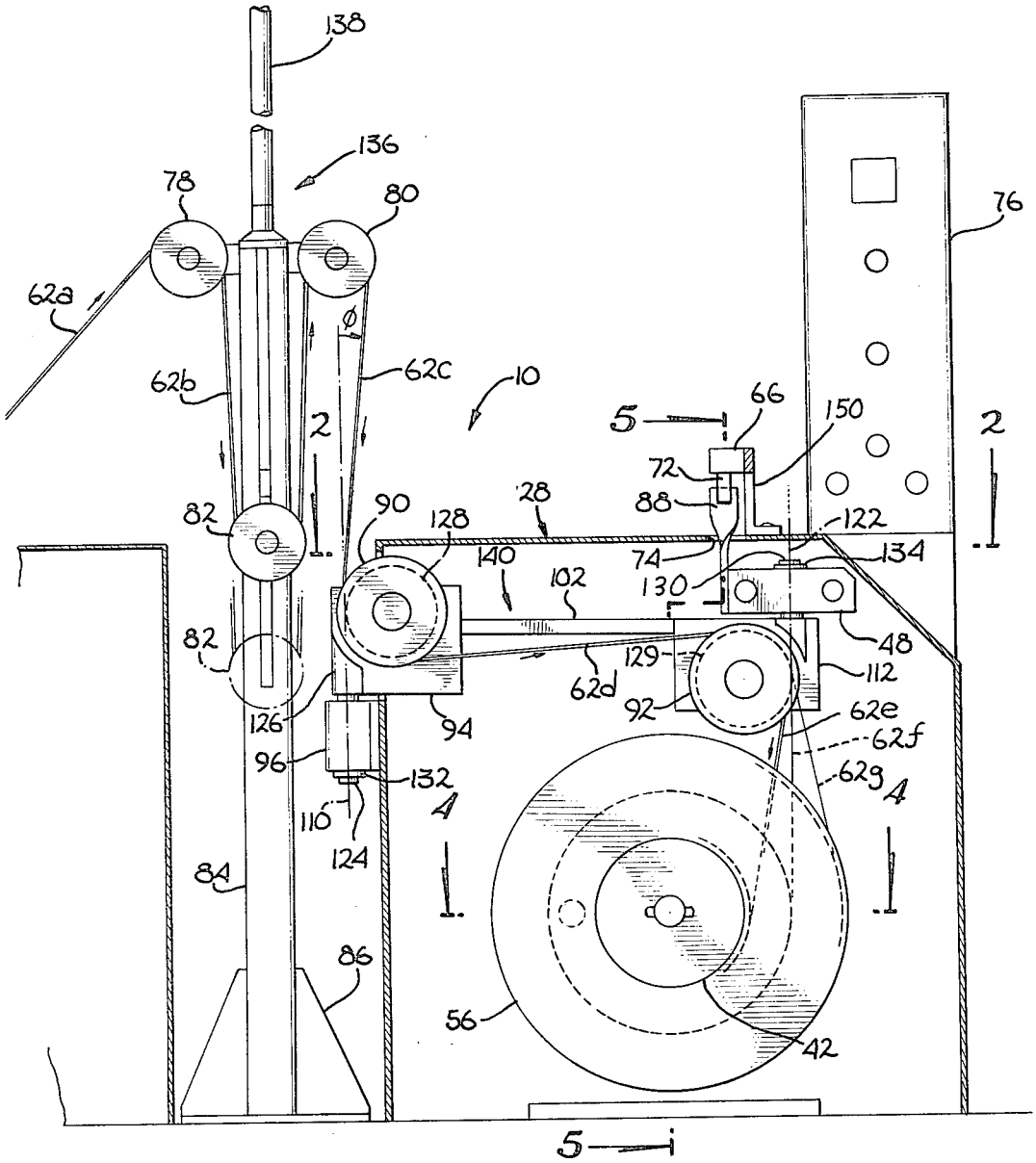
FIG. 1 is a side view of the subject invention.

With reference to the drawings, a preferred embodiment 10 of the subject invention is now described in detail. As shown in FIG. 4, the wire take-up machine 10, which is used in conjunction with the invented traverse apparatus, includes a housing generally indicated by the numeral 28 having an inner partition 30. A bearing housing 32, which is secured to partition 30, is used for rotatably mounting a reel spindle 44 by way of a pair of spindle bearings 46. One end of reel spindle 44, which extends a substantial distance through an opening in partition 30, receives a take-up reel 42. A dog plate 50 having a dog pin 52 is secured to spindle 44 which the dog pin engaging an opening in flange 58 of the reel so that the reel is driven by the spindle. A locking pin 54 located at an extreme end of spindle 44 is used to lock the reel into position on the spindle. Reel loading and removal is accomplished by removing pin 54 from the spindle.

A pulley 34 is mounted on the other end of the spindle 44 and secured in place by a key 118. A motor means 40, typically electric, having a pulley 36 attached to the motor drive draft, is used to drive pulley 34 by way of a drive belt 38. As will be discussed in greater detail below, the speed of motor means 40 may be varied, thereby controlling the rotation speed of spindle 44 and reel 42.

Referring now to FIGS. 1 and 6, the traversing apparatus used in conjunction with wire take-up machine 10 includes an input pulley assembly pivotally mounted on housing 28. This assembly includes an input pulley 90 rotatably mounted on a generally rectangular-shaped pulley bracket 94. An axle 124 having an upper mounting member 126 is secured to the pulley bracket 94 by welding or other suitable means such that the axis 110 of axle 124 is substantially tangential to the circle 128 defined by the bottom of the groove of pulley 90. Axle 124 is rotatably mounted in a bearing housing 96 by means of a pair of bearings 98 (see FIG. 6) and retained therein by a locking ring 132. The bearing housing 96 is bolted to the side of the machine housing 28 with pulley 90 extending approximately halfway into such housing through a rectangular opening located in the side of the housing. While in the embodiment of the invention shown in FIGS. 1 and 6, the axle 124 and bearing housing 96 are secured to the underside of pulley bracket 94, it should be understood that the present invention also contemplates securing the same to the upper side of bracket 94. Moreover, the present invention also contemplates an axle 124 and bearing housing 96 configured with a hollow center, coaxial with the axis 110 of axle 124, and adapted to pass through incoming wire. Such an embodiment would be suitable for applications in which the axle 124 and housing 96 lie between the source of incoming wire and the input pulley 90.

Figure 2:
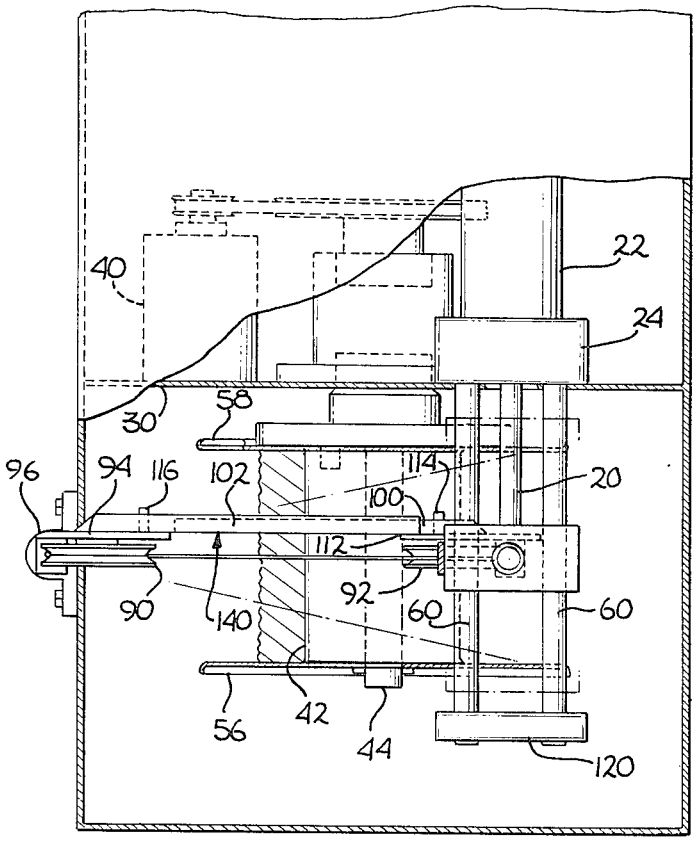
FIG. 2 is a cross-sectional plan view of the invention taken substantially through section line 2—2 of FIG. 1, showing the traverse apparatus in a center position.
Figure 3:
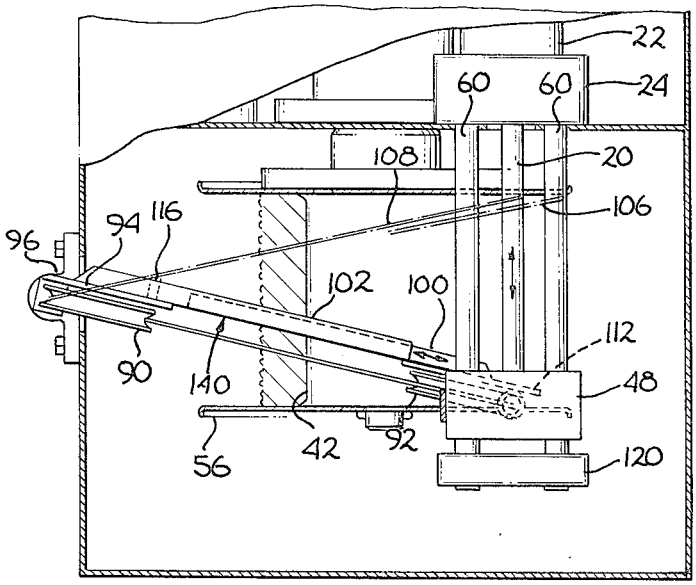
FIG. 3 is a cross-sectional plan view of the invention similar to FIG. 2, showing the traverse apparatus in an extreme offset position.

As can best be seen in FIGS. 2, 3 and 5, the traversing apparatus further includes a traversing block 48 slideably mounted on a pair of horizontal slide bars 60 which are substantially perpendicular with respect to axis 110 and substantially parallel to spindle 44. The slide bars 60, which are disposed above reel 42, are secured at one end to partition 30 by block 24. A support 120 is positioned at the opposite end of the slide bars 60 so as to maintain the bars in a parallel relationship. The traverse block 48 is driven by a cylinder rod 20 positioned between the slide bars 60 with the rod having one end attached to the block. Cylinder rod 20 is in turn driven by a conventional hydraulic cylinder which causes the traverse block 48 to travel back and forth along slide bars 60 at a controlled rate. The rate at which the traverse block reciprocates is determined by a control mechanism (not shown) having adjustment means. Such control mechanisms are well known in the wire take-up machine art.

As can best be seen in FIGS. 1 and 5, the traverse block carries a vertical striker 88 which reciprocates in a horizontal plane along with the block. Striker 88 extends upwardly through an elongated slot 74 formed in housing 28. A pair of limit switches, including a left limit switch 64 and right limit switch 66, are mounted on a horizontal mounting bracket 68 which is substantially parallel to slide rails 60. Bracket 68 is in turn mounted on housing 28 by way of a pair of mounting members 150. Switches 64 and 66 are each provided with a downwardly extending switch lever 70 and 72 respectively, which are contacted by the upwardly extending striker 88. Limit switches 64 and 66 are coupled to a conventional and well-known control mechanism (not shown) which causes the direction of travel of cylinder rod 20 and the traverse block 48 attached thereto to reverse when either switch is actuated by striker 88. The location of the limits switches 64 and 66 on bracket 68 are adjustable to control the reversal points of transverse block 48 to accommodate take-up reels of various flange-to-flange widths.

A traverse pulley assembly, substantially similar to the front pulley assembly discussed above, is pivotally mounted on the underside of traverse block 48. The traverse pulley assembly includes a traverse pulley 92 rotatably mounted on a pulley bracket 112. An axle 130 is positioned within an opening through the traverse block 48 and mounted therein on a pair of bearings (not shown). A locking ring 134 is used to secure axle 130 in place. Pulley 92 is mounted on bracket 112 such that the axis 122 of axle 130 is substantially tangential to the circle 129 defined by the bottom of the pulley 92 groove and parallel to axis 110 of axle 124. Axle 130 should be located on the traverse block 48 such that axis 122 projects downwardly between flanges 56 and 58 of the reel 42, and is displaced from the body of the reel 42 approximately half the distance of the desired or anticipated wire "fill."

Pulley bracket 94 of the input pulley assembly is connected to the traverse pulley bracket 112 of the traverse pulley assembly by way of an orientation bar 140 comprised of a forward member 102 and a rear member 100. As can be seen in FIGS. 2 and 3, pulley bracket 94 is provided with a pivot pin 116 for pivotally coupling one end of member 102 to the bracket in a manner such that member 102 is free to pivot in a substantially vertical plane. Similarly, traverse pulley bracket 112 is provided with a pivot pin 114 for pivotally coupling one end of member 100 to the bracket as to permit member 100 to pivot in a vertical plane. Forward member 102 of the orientation bar 140 defines a channel for receiving the free end of rear member 110 with the dimensions of the channel and rear member being such that the rear member is free to slide within the channel.

Referring now to FIG. 1, a wire tensioning device, generally designated by the numeral 136 and commonly called a "dancer," is disposed between a wire source (not shown) and the wire take-up machine 10. The purpose of the dancer is to maintain a relatively constant tension on the wire exiting the wire source and the wire entering the wire take-up machine throughout the winding process. Although a dancer is not essential to the operation of the subject invention, the performance of the invention will be improved in many applications where the wire source can supply wire only at a relatively fixed rate. The dancer includes a vertical support member 84 which is bolted or otherwise secured to the floor by way of bracket 86. Two spaced-apart fixed pulleys 78 and 80 are mounted on the upper portion of the dancer with a floating pulley 82 being located below and intermediate the fixed pulleys. Floating pulley 82 is carried by a piston rod (not shown) which is disposed within an air cylinder 138. A supply of compressed air is connected to air cylinder 138 which tends to force the piston rod and floating pulley 82 attached thereto downwardly to the position shown in the drawings in phantom. The amount of force is controlled by varying the pressure of the compressed air supplied to the air cylinder 138. Typically, pulley 82 has a total vertical stroke length of approximately 36 inches. As will be more thoroughly discussed below, a conventional electronic control mechanism (not shown) may be used advantageously in conjunction with the dancer to reduce automatically the rotational rate of the reel 42 as the wire fill increases on it (as required to maintain a generally constant wire velocity).

Operation of the subject invention is now described. The wire 62*a* from the wire source is first positioned over the fixed pulley 78 of the dancer and down around the floating pulley 82. The wire is then passed upwards over the second fixed pulley 80 and back down around the input pulley 90 of the traversing apparatus. The wire continues over the traverse pulley 92 and then down to the take-up reel 42. The dancer 84 should be positioned relative to the wire take-up machine such that the wire section 62*c* approaching pulley 90 defines a line which is substantially coincident with the axis 110 about which pulley 90 is free to pivot. The angle $\phi$ between axis 110 and wire section 62*c* is preferably less than $\pm 10$ degrees in the central plane defined by the input pulley 90 groove and traverse pulley 92 groove. In the event a dancer is not use, the traversing apparatus may further include an additional pulley equivalent to pulley 80 for the purpose of accurately guiding the wire from the source to the input pulley 90. While, in this embodiment, the fixed pulley 80 is disposed above input pulley 90, it could just as well be disposed below it.

In operation, motor means 40 drives spindle 44 and reel 42 carried by the spindle at a predetermined rate of rotation. As the wire 62*e* is wound around the reel, the traverse block 48 carrying traverse pulley 92 is driven by the reciprocating cylinder rod 20, causing pulley 92 to traverse the width of reel 42 in alternating directions. Thus, the traverse pulley 92 guides the wire to the take-up reel such that uniform layers of coiled wire are wound onto the reel. The speed at which the traverse pulley is reciprocated relative to the rotational rate of the reel 42 may be adjusted by conventional means so that each layer of wire wound on the reel is a coil of wire having a desired pitch. If the rate of traversing is increased, the pitch of the coils is increased; and, conversely, if the rate thereof is reduced, the pitch of the coils is decreased to a minimum of one wire diameter.

The reversal points of the traverse block 48 are set by adjusting (manually or automatically) the position of left and right limit switches 64 and 66, respectively, on bracket 68 so that the traverse block 48 reverses immediately prior to the wire 62*e* contacting either of the reel flanges 56 or 58.

As can best be seen in FIGS. 2 and 3, the orientation bar 140 disposed between the input pulley 90 and the traverse pulley 92 ensures that the pulleys are always "facing" one another, regardless of the position of the traverse block 48. FIG. 2 shows the traverse block 48 disposed midway between reel flanges 56 and 58 such that the axes of rotation of pulleys 80 and 92 are parallel to that of reel 42. In this position, the traverse pulley 92 is at its closest approach to input pulley 90 so that the rear member 100 of orientation bar 140 is almost completely positioned within the channel formed in forward member 102. As the traverse block 48 is driven from the midway position towards either reel flange, the orientation bar 140 causes pulleys 90 and 92 to pivot about axes 110 and 122 respectively, so that the pulleys continue to face one another. As shown in FIG. 3, rear member 100 of the orientation bar 140 withdraws continually from the channel of member 102 as the traverse pulley 92 approaches either reel flange, thereby increasing the effective length of the orientation bar 140. Thus, the increasingly greater distance between input pulley 90 and the traverse pulley 92 is accommodated. Pivot pins 116 and 114 permit the orientation bar 140 to pivot in a vertical plane so as to accommodate construction inaccuracies. For example, if the pivot axis 110 of inut pulley 90 is not precisely parallel to the pivot axis 122 of traverse pulley 92, or if axis 110 is not precisely normal to slide bars 60, the orientation bar can accommodate such inaccuracies by pivoting about pins 116 and 114.

As noted previously, dancer 136 serves to maintain a constant tension on the wire 62*c* as it enters the wire take-up machine. During the initial stages of the winding process, the air pressure of the compressed air supply coupled to air cylinder 138 of the dancer is adjusted to provide the desired wire tension loading. By means of adjusting the electronic control of motor means 40, the floating pulley 82 is positioned in its running position, typically the center of its stroke. The floating pulley will tend to oscillate about this running position to compensate for the small relatively instantaneous changes in the lineal speed of wire 62*c* as the traverse pulley 92 travels back and forth along the width of reel 42. For example, when the traverse pulley 92 is traveling away from the center of its path of travel towards either reel flange, the velocity of the wire 62*c* momentarily increases slightly as the distance from pulley 90 to pulley 92 increases. Floating pulley 82 will momentarily shift upwardly so as to maintain a relatively constant tension on the wire by feeding accumulated wire. Similarly, as the traverse pulley approaches the center of its path of travel, the floating pulley will momentarily shift downwards so as to compensate for the reduction in the speed of wire 62*c*, thereby maintaining a constant wire tension by taking up the resulting slack in the wire.

As wire continues to be wound around the body of reel 42, the effective diameter of the reel increases thereby causing the lineal speed of the wire 62*c* to increase. In many applications, the lineal speed of the wire 62*a* from the wire source is relatively constant as, for example, in applications wherein the source is a wire extruding machine or the like. In such cases, the rotational speed of the reel 42 must be reduced to compensate for the increased effective reel diameter. As previously noted, a control mechanism (not shown) can accomplish this reel speed reduction automatically, in conjunction with the dancer. The control mechanism is adapted to sense the position deviations of the floating pulley 82 with respect to its nominal reference or "running point" and to generate a corresponding error signal. The error signal is used to vary the speed of motor means 40 which drives the reel 42 so as to reduce its speed and to cause the pulley 82 to return to its running point, (thereby nulling the error signal). Thus, if the average speed of the wire increases, the mechanism senses the corresponding movement of the floating pulley 82 in the upward direction, and generates an error signal. In response to the error signal, the control mechanism reduces the speed of electric motor 40, thereby causing the wire speed to decrease. By operation of the dancer, the pulley 82 drops to its running point in response to the wire speed reduction. The latter motion tends to null the error signal. A more detailed description of the dancer operation and the foregoing control mechanism is disclosed in U.S. Pat. No. 3,599,500 to Bravin.

The novel positive self-orienting traverse apparatus described herein is capable of accurately guiding the wire to the take-up reel 42 so as to lay uniform layers without damaging or stressing the wire. Because the incoming wire 62*c* is substantially coincident with axis 110 about which the groove of input pulley 90 pivots, the incoming wire section is not adversely affected by the pivoting of the input pulley 90 as the traverse pulley 92 reciprocates. Similarly, orientation bar 140 ensures that the grooves of pulley 90 and 92 define a common central plane (i.e., that they remain co-planar), which includes axis 110, throughout the traverse cycle. This feature ensures that the wire section 62*d* exiting pulley 90 and entering traverse pulley 92 lies in the same plane as the grooves of pulleys 90 and 92 and that it engages only the bottom of the respective pulley grooves thereby avoiding contact with the walls of the pulley grooves. In this manner, the present invention overcomes the disadvantages and shortcomings described earlier, which have heretofore limited the winders known in the prior art.

As previsouly noted, the axle 130 of the traverse pulley 92 is mounted with respect to reel 42 such that axis 122 of the axle projects downwardly between flanges 56 and 58 and is displaced from the reel approximately one half of the depth of the flanges. As can best be seen in FIG. 1, during the initial stages of the winding process, the wire exiting the traverse pulley takes the path 62*e* which is displaced somewhat from axis 122. Wire path 62*f*, which is coincident to axis 122, shows the path taken by the wire when the reel is approximately half wound. Finally, wire section 62*g* shows the path of the wire when the reel is almost fully wound with the wire section 62*g* being displaced slightly from axis 122 in a direction opposite from that of section 62*e*. This arrangement ensures that the wire section exiting traverse pulley 92 is as nearly coincident with axis 122 as possible throughout the winding process so that the wire exiting the pulley is relatively unaffected by the pivoting of pulley 92 about the axis. The only significant lateral force imparted to the wire exiting pulley 92 is, therefore, that force required to guide the wire accurately onto the reel 42.

Thus, a novel, positive self-orienting traverse apparatus has been disclosed which accurately guides wire onto the take-up reel. The apparatus will not abrade or stress the wire and can, therefore, be used for winding wire of an extremely fine guage. Furthermore, the wire will have no tendency to climb the walls of the input or traverse pulley grooves and, thus, will be less likely to be thrown from these pulleys of the apparatus. Pulleys having narrow grooves which accurately guide the wire can be used without fear of damaging the wire. Furthermore, this invention does not require a long distance between the wire supply or fixed pulley and the traverse pulley, thereby eliminating the need for a great amount of floor space and safety guards for workers.

It is, of course, to be understood that while a particular embodiment has been disclosed, various changes in form, detail and application of the present invention may be made without departing from the spirit and scope of the invention. For example, although the apparatus has been described for use in conjunction with wire, it is apparent that the apparatus can also be used for winding cable, rope or the like.

I claim:

1. In an apparatus for winding wire and the like in uniform layers onto a reel, the combination comprising:

a first wire guide means for defining a first wire path and guiding wire along said first path;

a first pivot means for pivotally mounting said first wire guide means about a first axis, said first axis of said first pivot means being substantially tangential to said first wire path defined by said first wire guide means;

a second wire guide means for defining a second wire path and guiding wire along said second path;

a second pivot means for pivotally mounting said second wire guide means about a second axis;

orientation means coupled to said first and to said second wire guide means, said orientation means being a means for maintaining said first and second wire paths substantially co-planar; and drive means for reciprocally driving said second wire guide means along a predetermined path, whereby said wire from a wire source is guided from said source to said first wire guide means, from said first wire guide means to said reciprocating second wire guide means and then from said second wire means onto said reel.

2. The apparatus of claim 1 wherein said first axis of said first pivot means is substantially coincident with a line defined by that portion of said wire which approaches said first wire guide means.

3. The apparatus of claim 1 further including a third wire guide means for guiding wire from said source to said first wire guide means, with said third wire guide means being positioned relative to said first wire guide means such that that portion of the wire approaching said first wire guide means defines a line which is substantially coincident with said first axis.

4. In an apparatus for winding wire and the like in uniform layers onto a reel, the combination comprising:

a first wire guide means for defining a first wire path and guiding wire along said first path;

a first pivot means for pivotally mounting said first wire guide means about a first axis;

a second wire guide means for defining a second wire path and guiding wire along said second path;

a second pivot means for pivotally mounting said second wire guide means about a second axis;

orientation means coupled to said first and to said second wire guide means for maintaining said first and second wire paths substantially co-planar, said orientation means comprising a substantially rigid elongated member having a first end coupled to said first wire guide means and a second end coupled to said second wire guide means, and further comprising a means for varying the length of said elongated member in response to a position of said second wire guide means along said predetermined path;

drive means for reciprocally driving said second wire guide means along a predetermined path, whereby said wire from a wire source is guided from said source to said first wire guide means, from said first wire guide means to said reciprocating second wire guide means and then from said second wire guide means onto said reel.

5. The apparatus of claim 4 wherein said orientation means is a substantially rigid elongated member comprised of at least two elements slidably mounted with respect to one another, with a first end of said elongated member being coupled to said first wire guide means and a second end of said elongated member being coupled to said second wire guide means.

6. The apparatus of claim 4 wherein said orientation means further includes:

a first coupling means for pivotally coupling said first end of said elongated member to said first wire guide means such that said first end may pivot with respect to said first guide means about an axis substantially perpendicular to said first axis; and a second coupling means for pivotally coupling said second end of said elongated member to said second wire guide means such that said second end may pivot with respect to said second wire guide means about an axis substantially perpendicular to said second axis.

7. In an apparatus for winding wire and the like in uniform layers onto a reel, the combination comprising:

a first pulley having a wire carrying groove for guiding wire along a first path;

a first pivot means for pivotally mounting said first pulley about a first axis, said first axis of said first pulley being substantially tangential to a circle defined by said wire carrying groove of said first pulley;

a second pulley having a wire carrying groove for guiding wire along a second path;

a second pivot means for pivotally mounting said second pulley about a second axis;

orientation means coupled to said first and to said second pulleys, said orientation means being a means for maintaining said first and second wire paths substantially co-planar; and drive means for reciprocally driving said second pulley along a predetermined path, whereby said wire from a wire source is guided from said source to said first pulley, from said first pulley to said reciprocating second pulley and then from said second pulley onto said reel.

8. The apparatus of claim 7 further including a third wire guide means for guiding wire from said source to said first pulley with said third wire guide means being positioned relative to said first pulley such that that portion of the wire approaching said first pulley defines a line which is substantially coincident with said first axis.

9. The apparatus of claim 7, wherein said first axis of said first pivot means is substantially coincident with a line defined by that portion of said wire which approaches said first pulley.

10. The apparatus of claim 9 wherein said reel is rotated about an axis of rotation and includes a reel body about which wire is wound and flanges on either end of said body and wherein said second axis of said second pivot means is substantially at right angles to said axis of rotation and displaced from said body approximately half the distance that said flanges extend from said body.

11. The apparatus of claim 10 wherein said first and second axes are substantially at right angles to said predetermined path of said second pulley.

12. The apparatus of claim 11 wherein said orientation means comprises a substantially rigid elongated member having a first end coupled to said first pulley and a second end coupled to said second pulley and a means for varying the length of said elongated member in response to a position of said second pulley along said predetermined path.

13. In an apparatus for reeling wire and the like in uniform layers onto a reel, the combination comprising:

a first pulley defining a first pulley groove;

a first pivot means for pivotally mounting said first pulley about a first axis which is substantially tangential to said first pulley groove;

a second pulley defining a second pulley groove;

a second pivot means for pivotally mounting said second pulley about a second axis which is substantially tangential to said second pulley groove;

orientation means coupled to said first and to said second pulleys, said orientation means being a means for maintaining said first and second pulley grooves substantially co-planar; and drive means for reciprocally driving said second pulley along a predetermined path which is substantially at right angles to said first and second axis, whereby said wire from a wire source is guided from said source to said first pulley, from said first pulley to said reciprocating second pulley and then onto said reel.

14. The apparatus of claim 13 wherein said reel is rotated about an axis of rotation and includes a reel body about which wire is wound and flanges on either end of said body with said second axis of said second pivoting means is substantially at right angles to said axis of rotation and displaced from said reel body approximately half the distance which is to be filled with wire, and wherein said orientation means comprises a substantially rigid elongated member having a first end coupled to said first pulley and a second end coupled to said second pulley and a means for varying the length of said elongated member in response to a position of said second pulley along said predetermined path.

15. The apparatus of claim 14 further including a wire guide means for guiding wire from said wire source to said first pulley with said wire guide means being positioned relative to said first pulley such that that portion of said wire approaching said first pulley defines a line which is substantially coincident with said first axis.

* * * * *

UNITED STATES PATENT AND TRADEMARK OFFICE

CERTIFICATE OF CORRECTION

PATENT NO. : 4,232,838

DATED : 11/11/80

INVENTOR(S) : Ben Bravin

It is certified that error appears in the above-identified patent and that said Letters Patent are hereby corrected as shown below:

| COLUMN | LINE | DESCRIPTION |
|---|---|---|
| 1 | 13 | Delete "3", insert --2--. |
| 2 | 33 | Delete "expecially", insert --especially--. |
| 5 | 12 | Delete "draft", insert --shaft--. |
| 7 | 30 | Delete "use"; insert --used--. |
| 9 | 28 | Delete "previsouly", insert --previously-- |

Signed and Sealed this

*Twentieth* Day of *November 1984*

[SEAL]

*Attest:*

GERALD J. MOSSINGHOFF

*Attesting Officer*

*Commissioner of Patents and Trademarks*